US008047410B2

(12) United States Patent
Holm et al.

(10) Patent No.: US 8,047,410 B2
(45) Date of Patent: Nov. 1, 2011

(54) COMPACT HANGING CLOTHING ASSEMBLY

(75) Inventors: Katie Holm, Minneapolis, MN (US); Neal Anderson, Edina, MN (US)

(73) Assignee: Target Brands, Inc., Minneapolis, MN (US)

( * ) Notice: Subject to any disclaimer, the term of this patent is extended or adjusted under 35 U.S.C. 154(b) by 548 days.

(21) Appl. No.: 12/113,787

(22) Filed: May 1, 2008

(65) Prior Publication Data

US 2009/0272771 A1 Nov. 5, 2009

(51) Int. Cl.
*A41D 27/22* (2006.01)

(52) U.S. Cl. ..... 223/93; 223/85; 223/92

(58) Field of Classification Search ..... 223/85, 223/88, 92, 93, 95–96; 2/22, 23, 47, 69.5, 2/74, 919

See application file for complete search history.

(56) References Cited

U.S. PATENT DOCUMENTS 1,886,126 A * 11/1932 Sessions ..... 223/88
1,990,278 A 2/1935 Friedmann
1,991,987 A * 2/1935 Smith ..... 223/91
2,517,336 A * 8/1950 Neal ..... 223/91
2,634,422 A 4/1953 Cantrell
3,323,657 A * 6/1967 Robbins ..... 211/175
3,334,736 A * 8/1967 Cole et al. ..... 223/85
3,346,879 A 10/1967 Buzzelli
4,189,049 A * 2/1980 Silver ..... 206/216
4,212,403 A * 7/1980 Zeigler et al. ..... 223/85
4,404,687 A 9/1983 Hager
4,601,417 A * 7/1986 Kunreuther ..... 223/85
5,014,957 A * 5/1991 Nichol, Jr. ..... 223/85
5,016,284 A * 5/1991 Brown ..... 2/69
5,025,963 A * 6/1991 Goldfarb et al. ..... 223/85
5,052,059 A 10/1991 Speer
5,584,074 A 12/1996 Battle-Smith
5,864,885 A 2/1999 Grinberg
5,946,780 A 9/1999 Borcherds et al.
5,960,471 A * 10/1999 Burton ..... 2/48
5,992,713 A * 11/1999 Manabat ..... 223/96
6,029,869 A * 2/2000 Rice ..... 223/88
6,036,064 A * 3/2000 Tawil ..... 223/88
6,298,488 B1 10/2001 Duncan et al.
6,351,869 B1 3/2002 Jones (Continued)

OTHER PUBLICATIONS

Target Corporation, Excerpt from Halloween Packaging Tag and Instructions, available at least as of some time Sep. 2007, (1 pg.).

*Primary Examiner* — Nathan Durham
(74) *Attorney, Agent, or Firm* — Griffiths & Seaton PLLC

(57) ABSTRACT

A hanging clothing assembly includes a hanger, a clothing item, and a hanging strap. The hanger has a body portion and an upper support portion. The clothing item has a free-hanging length and defines an upper portion configured to be worn over an upper body of a wearer and a lower portion configured to be worn over a lower body of the wearer. The upper portion of the clothing item is supported on the body portion of the hanger. The hanging strap is secured to the lower portion of the clothing item and is also releasably secured in a closed loop that extends about the lower portion of the clothing item. The closed loop is releasably secured to the hanger such that the lower portion is supported from the hanger and the clothing item defines a display-hanging length that is less than the free-hanging length of the clothing item.

17 Claims, 2 Drawing Sheets

U.S. PATENT DOCUMENTS 6,473,905 B1 * 11/2002 Katz ..... 2/48
6,651,810 B2 * 11/2003 Nichol, Jr. ..... 206/297
7,058,988 B1 6/2006 Zahner
2004/0050727 A1 3/2004 Fraistat et al.
2004/0206788 A1 * 10/2004 Capuano et al. ..... 223/96
2007/0295769 A1 * 12/2007 Burroughs ..... 223/85

* cited by examiner

COMPACT HANGING CLOTHING ASSEMBLY

BACKGROUND

Stores that sell, store, and display costumes, day-to-day clothing, and the like can encounter problems hanging such lengthier clothing products. Some retailers hang the products on clothing hangers with the products disposed in clear, plastic bags that have holes in them toward their bottom ends. To provide a more compact display, the products are hung on the hangers, the lower portions of the bags are brought up to the hangers, and the hook portions of the hangers are inserted through the holes at the bottoms of the bags.

SUMMARY

Various aspects of the invention relate to systems, assemblies, and methods of displaying more lengthy, or complex clothing products on hangers in a more compact configuration while retaining a pleasing appearance and providing an environmentally-friendly solution that allows the clothing products to be taken off the hangers, tried on, and re-hung in the more compact storage/display configuration, although additional or alternate features and combinations thereof are contemplated.

In some embodiments, a hanging clothing assembly includes a hanger, a clothing item, and a hanging strap. The hanger has a body portion and an upper support portion. The clothing item has a free-hanging length and defines an upper portion configured to be worn over an upper body of a wearer and a lower portion configured to be worn over a lower body of the wearer. The upper portion of the clothing item is supported on the body portion of the hanger. The hanging strap is secured to the lower portion of the clothing item and is also releasably secured in a closed loop that extends about the lower portion of the clothing item. The closed loop is releasably secured to the hanger such that the lower portion is supported from the hanger and the clothing item defines a display-hanging length that is less than the free-hanging length of the clothing item.

This summary is not intended to be limiting in nature. Various other aspects and embodiments are contemplated and should be understood with reference to the text and drawings that follow.

Figure 3:
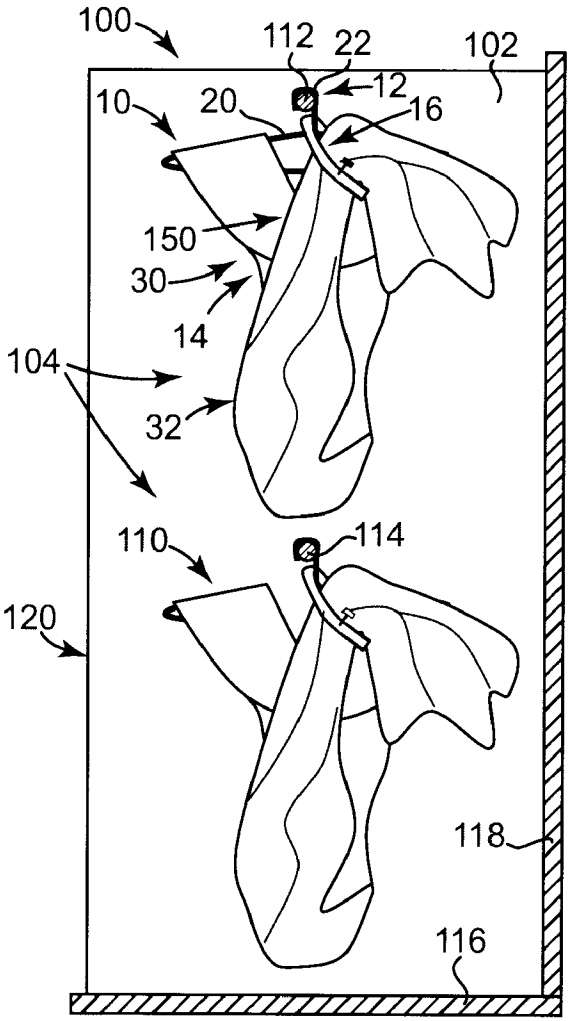
FIG. 3 is a front view of a display system including two clothing assemblies in gathered, compact configurations, each of the clothing assemblies hanging from a clothing rack fixture, according to some embodiments.

Some embodiments have been shown by way of example in the drawings and are described in detail below. As alluded to above, the intention, however, is not to limit the invention by providing such examples.

DETAILED DESCRIPTION

As previously summarized, some embodiments address displaying more lengthy, or complex clothing products on hangers in a compact configuration while retaining a pleasing appearance, providing an environmentally-friendly solution, and allowing the products to be taken off the hangers, tried on, and re-hung in the more compact storage/display configuration, although additional or alternate features and combinations thereof are contemplated.

Figure 1:
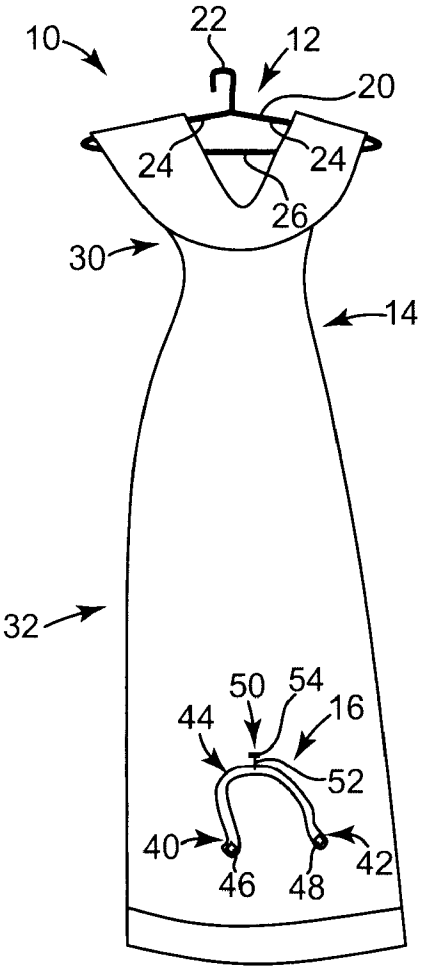
FIG. 1 is a front view of a clothing assembly in a full length, ungathered configuration, according to some embodiments.

FIG. 1 shows a front view of a clothing assembly 10 in a full length, ungathered configuration, according to some embodiments. The clothing assembly 10 includes a hanger 12, an article of clothing 14, and a strap 16. In some embodiments, the article of clothing 14 is hung from the hanger 12 and is also secondarily secured to the hanger 12 using the strap 16, such that an overall hanging length of the article of clothing 14 is reduced.

In some embodiments, the hanger 12, also referred to as a clothing hanger or article hanger, includes a body portion 20 and an upper support portion 22, also referred to as an upper clasp. In some embodiments, the body portion 20 includes laterally opposed support arms 24 connected by a cross-piece 26, such that the body portion 20 is substantially triangular in shape, although a variety of configurations for the body portion 20 are contemplated. The upper support portion 22 forms a hook having an inverted J-shape and being adapted to be disposed over a rod, or other structure adapted for supporting clothing. In more functional terms, the hanger 12 provides means for hanging the article or article(s) of clothing 14 from clothing racking by supporting one or more portions the clothing 14. The hanger 12 is optionally formed of wire, plastic, or other material and optionally takes any shape or form generally attributed to clothing hangers or the like. In some embodiments, the hanger 12 is adapted to be received inside the clothing 14 such that portions of the clothing 14 that correspond to shoulders of a person are supported by the support arms 24 of the hanger 12.

As shown in FIG. 1, the clothing 14 is optionally a dress, or is substantially dress-like in nature, although any of a variety of clothing types and cuts are contemplated, such as coveralls, bodysuits, or other types of clothing. The clothing 14 is also referred to as a clothing article or a clothing item for example. The clothing 14 includes a torso portion 30 and a leg portion 32, also described as upper and lower portions or parts, respectively. The torso portion 30 is optionally adapted to cover portions of an upper body, or torso of a person (not shown). In turn, the leg portion 32 is optionally adapted to cover portions of a lower body of the person (not shown), including such lower extremities as the hips, thighs, and legs. Thus, in some embodiments and in functional terms, the torso and leg portions 30, 32, respectively, provide means for covering a torso of a person and means for covering lower extremities of the person. The clothing 14 generally defines a free-hanging length, or full length, corresponding to the clothing 14 being in a natural state or configuration. The natural configuration of the clothing 14 corresponds to the clothing 14 being configured as worn or as the clothing would hang in an unfolded configuration from the hanger 12. The clothing 14 is optionally formed of any of a variety of materials suitable for clothing use.

The strap 16 is also described as a hanging strap, an elongate member, or a band of material. The strap 16 includes a first end portion 40, a second end portion 42, and a middle portion 44 extending between the first and second end portions 40, 42. The first end portion 40 is also referred to as a first end, the second end portion 42 is also referred to as a second end, and the middle portion 44 is also optionally referred to as a mid-portion, an intermediate portion, or a third portion, for example. In some embodiments, the first end portion 40 includes a first fastener 46 and the second end portion 42 includes a second fastener 48. The first and second fasteners 46, 48 are optionally complementary pieces of hook and loop fastener material, such as that sold under the trade name "VELCRO." For example, the first fastener 46 is optionally a piece of hook material and the second fastener 48 is optionally a piece of loop material adhered or sewn, for example, to the first and second end portions 40, 42, respectively. Any of a variety of fasteners are also contemplated for the first and second fasteners 46, 48, including complementary adherents, magnets, clasps, and others.

As shown in FIG. 1, the strap 16 is secured to the lower, leg portion 32 using a fastener 50, such as those known as plastic "swift tacks," plastic clips, plastic rivets, or plastic staples, although a variety of fastening means such as stitching or hook and loop materials, are also contemplated. As generally shown in FIG. 1, the fastener 50 includes a thin, elongate body 52, a first tabbed end 54 on one side of material forming the clothing 14 and a second tabbed end (not shown) on an opposite side of the material forming the clothing 14. In use, the elongate body 52 is threaded through the clothing 14 and the strap 16 and the tabbed ends 52, 54 act to keep the fastener 50 and strap 16 secured to the clothing 14. In some embodiments, the fastener 50 is generally designed to be destructively removed. In other words, a portion of the fastener 50, such as the elongate body 52 is substantially destroyed or broken to remove the fastener 50 without causing damage to the clothing 14.

Figure 2:
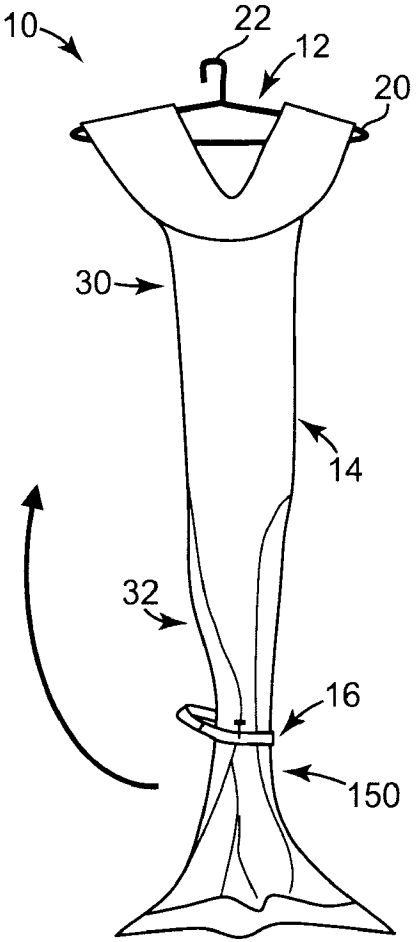
FIG. 2 is a front view of the clothing assembly of FIG. 1 in a full length, gathered configuration, according to some embodiments.

Some methods of displaying and retailing clothing are described below with reference to FIGS. 1-3, where FIG. 2 shows the clothing assembly 10 in a more compact state than the natural, full length state of the clothing 14, the more compact state also being described as a display state. FIG. 3 shows a clothing racking system 100 including a clothing display fixture 102 supporting a plurality of clothing assemblies 104, such as the clothing assembly 10 and a second, substantially similar clothing assembly 110. The clothing display fixture 102 is shown in cross-section in FIG. 3 and is optionally part of a shelving unit or gondola positioned in a retail environment.

The clothing display fixture 102, also described as a rack, includes an upper rod 112 and a lower rod 114 positioned in a tiered configuration, one above the other, with each of the upper and lower rods 112, 114 being adapted to support clothing hangers. The upper and lower rods 112, 114 are also referred to as upper and lower hanger supports, respectively. Although the clothing display fixture 102 includes rod-like structures for supporting hangers, a variety of hanger support means, including pegboard or others, are also contemplated. As shown, the clothing display fixture 102 also includes a base 116 to be supported on a floor and an optional back wall 118 opposite a front 120 of the clothing display fixture 102, where a viewer of the clothing assemblies 104 would typically be looking toward the back wall 118.

As shown in FIG. 1, the clothing 14 is optionally hung or otherwise supported from the hanger 12 by inserting the body portion 20 in the clothing 14 and supporting the upper, torso portion 30, for example the part where the person's shoulders would be disposed, on the body portion 20 of the hanger 12. As previously referenced, the strap 16 is secured to the lower, leg portion 32 of the clothing 14 using the fastener 50.

As shown in FIG. 2, the lower, leg portion 32 is gathered together, for example by rolling, folding, and/or bunching the lower, leg portion 32 together into a bunched section 150, or bunched portion, proximate where the strap 16 is fastened. The first and second end portions 40, 42 (FIG. 1) of the strap 16 are brought together and fastened, such that the strap 16 is fastened end-to-end to form a continuous loop about the bunched section 150. The strap 16 optionally helps keep the bunched section 150 bundled, folded, rolled, or otherwise bunched together as desired.

As designated by the arcuate arrow in FIG. 2 and as shown in FIG. 3, the strap 16, along with the lower, leg portion 32 is folded upwardly toward the hanger 12 and the strap 16 is hooked over the upper support portion 22 such that the strap 16, and thus the lower, leg portion 32 of the clothing 14, is secondarily secured to the hanger 12 via the strap 16 and the upper, torso portion 30 is supported from the body portion 20 of the hanger 12. In this manner, the strap 16 provides part of the means for transitioning the clothing assembly 10 from a first state to a display state, where in the first state the clothing 14 has a natural, ungathered, and full, free-hanging length and in the display state the clothing 14 has a more compact display-hanging length that is less than the free-hanging length of the clothing 14.

In some methods of retailing, displaying, and storing clothing articles, such as clothing 14, a plurality of clothing assemblies, such as the clothing assembly 10, are hung from the upper rod 112 and a plurality of clothing assemblies, such as the second clothing assembly 110, are hung from the lower rod 114 to form an upper tier of clothing articles and a lower tier of clothing articles that are substantially divided, or separated, from each other. Transitioning the clothing assemblies 10, 110 to their display states helps facilitate the display and storage of a plurality of clothing items at less than their full lengths in a neat, tiered, and more compact arrangement. It should be noted that the clothing assemblies 10, 110 need not be arranged in a tiered manner to garner benefits from placing the clothing assemblies 10, 110 in their display states. For example, a relatively shorter clothing display fixture 102 is optionally employed, where the compact state of the clothing assemblies 10, 110 helps avoid or reduce an amount of dragging or contact between the clothing 14 and the base 116 of the display fixture 102.

Furthermore, in some embodiments, consumers or others are readily able to remove, view at full length (on the hangers or off the hangers), and then replace the clothing assemblies in their display states. For example, the clothing assembly 10 is optionally transitioned between the display state and the first state to allow viewing of the clothing 14 at its full length, or even to try on the clothing 14.

To view the clothing 14 at full length, the strap 16 is removed from the upper support portion 22 of the hanger 12. The strap 16 is released so that the strap 16 is in an open configuration and the lower, leg portion 32 of the clothing 14 is unbundled, or ungathered, and transitioned into a natural, full length, and ungathered configuration. The clothing 14 is viewed at its natural, full length, and ungathered configuration on the hanger 12 or is optionally removed from the hanger 12 and tried on. After the clothing 14 has been viewed at full length, the bunched portion 150 is regathered and the strap 16 is resecured about the bunched portion 150. The lower, leg portion 32 of the clothing 14 is brought up toward the hanger 12 and the strap 16 is resecured to the hanger 12 once again to decrease the hanging length of the clothing 14.

In some embodiments, consumers or other users are provided directions on or near the display fixture 102 or on the clothing 14 instructing them to and/or how to place the clothing assembly 10 in the compact configuration on the display fixture 102. Additionally, the strap 16 is optionally brightly colored, for example bright orange or yellow, or is colored to distinctly stand out from the clothing 14, to encourage drawing a user's attention to the strap 16. By causing the strap 16 to pop out, or otherwise be visually distinct from the clothing 14, users are able to readily find the strap 16 and are reminded of the strap 16, for example, such that the users are encouraged to replace the clothing assembly 10 in the compact state or configuration.

Figure 4:
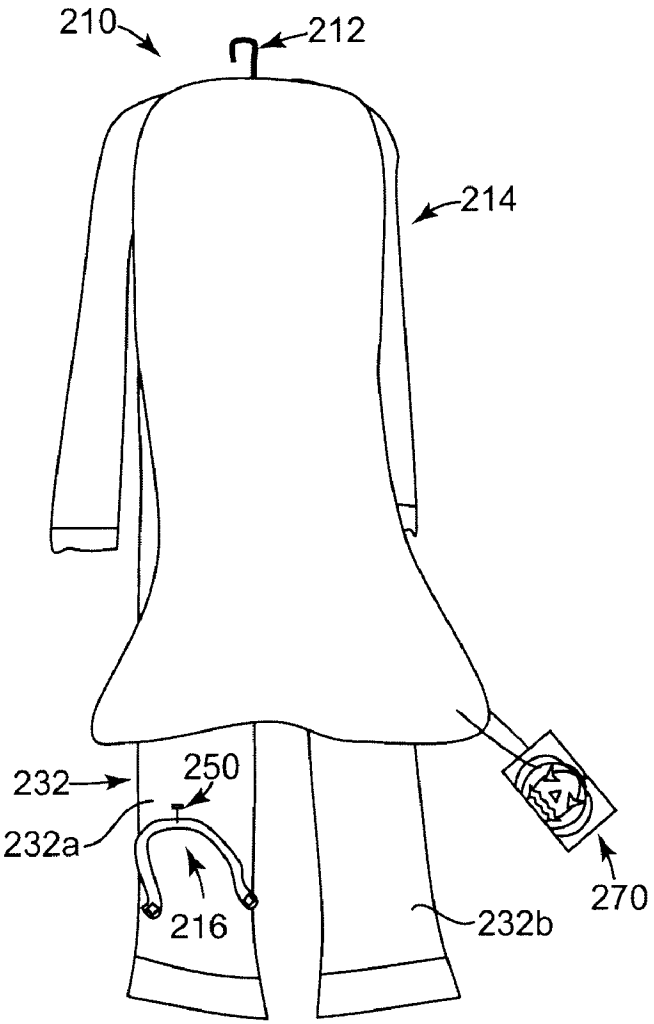
FIG. 4 is a back view of another clothing assembly in a full length, ungathered configuration, according to some embodiments.

FIG. 4 is a back view of another clothing assembly 210 that operates in a substantially similar manner to the clothing assemblies 10, 110. As shown, the clothing assembly 210 includes a hanger 212, an article of clothing 214, and a strap 216 secured to a lower, leg portion 232 of the article of clothing 214. As shown in FIG. 4, in some embodiments, the clothing 214 has a coverall-type of design and is optionally a Halloween costume including labeling 270 or other indicia indicating that the clothing 214 is a Halloween costume. The lower, leg portion 232 of the article of clothing 214 includes a back of a first pant leg 232*a* to which the strap 216 is secured using a fastener 250. The strap 216 is used similarly to the strap 16 (FIG. 1), for example by looping the strap 216 around the first pant leg 232*a* and a second pant leg 232*b* and securing the strap 216 to the hanger 212.

Figure 5:
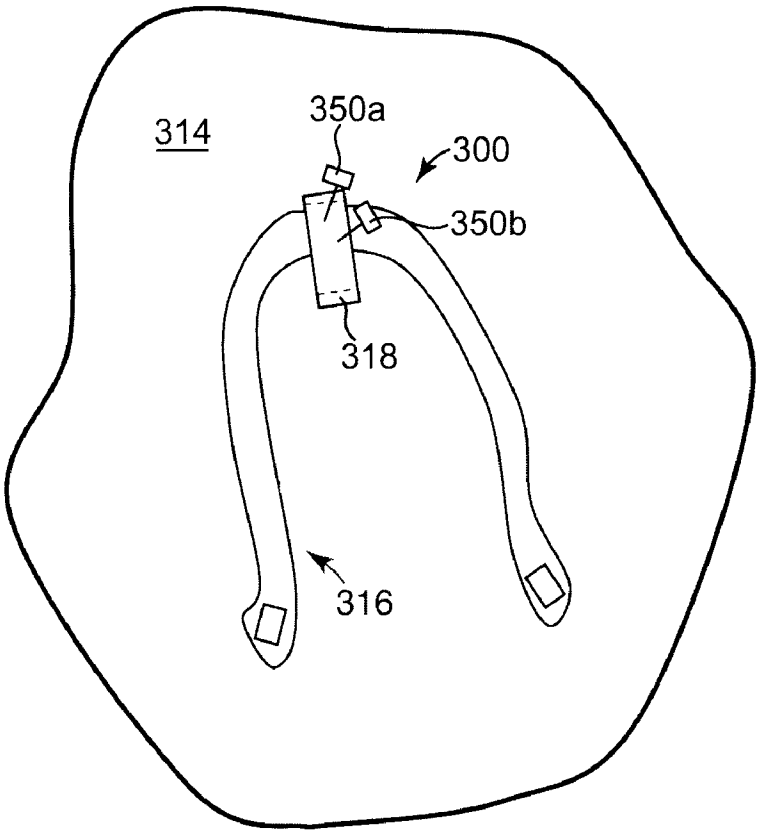
FIG. 5 is a close-up view showing a portion of another clothing assembly, according to some embodiments.

FIG. 5 shows a strap assembly 300 to be sewn to clothing 314, the assembly including a strap 316, a tab 318, and fasteners 350*a*, 350*b*. As shown by the dotted lines in FIG. 5, opposing ends of the tab 318 are optionally sewn to the clothing 314 and the strap 316, which is optionally similar to those previously described, is threaded through the tab 318. If desired, the strap 316 is secured to the tab 318 using the fasteners 350*a*, 350*b* as shown, which are optionally substantially similar to those previously described, but in some embodiments is able to slide freely through the tab 318. The strap assembly 300 is optionally similar in use and positioning to that of the strap 16.

In view of the foregoing, various embodiments have been shown and described addressing displaying clothing on hangers in a compact configuration that provides a neat appearance and uses less space on hanging fixtures. Various embodiments allow the clothing to be transitioned to their full length and viewed on the hangers or taken off the corresponding hangers on which they are hung, tried on, and re-hung in their more compact storage/display configurations. The ease of use, along with brightly colored or otherwise visually contrasting straps where applicable, encourage consumers or other users to replace the clothing assemblies in their compact, neat configurations. Additionally, various embodiments reduce or eliminate the need to utilize plastic bags or other accessories to keep the clothing bundled/folded, thereby reducing material use and costs, thereby achieving positive environmental impact.

Various modifications and additions can be made to the embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

In the description, reference is made to the accompanying drawings, which form a part hereof, and in which is shown by way of illustration specific embodiments in which the invention may be practiced. In this regard, directional terminology, such as "top," "bottom," "front," "back," "left," "right," etc., is used with reference to the orientation of the Figure(s) being described. Because components of the various embodiments can be positioned in a number of different orientations, the directional terminology is used for the purposes of illustration and is in no way limiting. The detailed description, therefore, is not to be taken in a limiting sense, and the scope of the present invention is defined by the appended claims.

The following is claimed:

1. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap has a first end portion, a second end portion, and a mid-portion extending between the first and second end portions, the first and second end portions including complementary hook and loop material releasably securing the first and second ends together and the mid-portion being secured to the clothing item.

2. The assembly of claim 1, wherein the lower portion of the clothing item is gathered together to form a gathered section, and the closed loop formed by the hanging strap extends around the gathered section.

3. The assembly of claim 2, wherein the upper support portion of the article hanger includes a hook, and the closed loop extends around the hook to secure the gathered section of the clothing item to the hook.

4. The assembly of claim 1, further comprising:

a clothing display fixture including an upper hanger support member and a lower hanger support member positioned below the upper hanger support member, wherein:

the clothing item is a first clothing item of a plurality of clothing items, the article hanger is a first article hanger of a plurality of article hangers, the hanging strap is a first hanging strap of a plurality of hanging straps, each of the plurality of clothing items is supported from a corresponding one of the plurality of article hangers, and a corresponding one of the plurality of hanging straps is coupled with the corresponding one of the plurality of article hangers such that each of the plurality of clothing items defines a display-hanging length that is less than a free-hanging length of each of the plurality of clothing items, and the plurality of clothing items are positioned in a tiered configuration including a first tier of clothing items hanging from the upper hanger support member and a second tier of clothing items hanging from the lower hanger support member.

5. The assembly of claim 4, wherein the upper hanger support member and the lower hanger support member are positioned relative to one another such that:

when one or more of the plurality of clothing items in the first tier of clothing items hangs from the upper hanger support member at the display-hanging length, the one or more of the plurality of clothing items in the first tier of clothing items is spaced entirely above the second tier of clothing items, and when the one or more of the plurality of clothing items in the first tier of clothing items hangs from the upper hanger support member at the free-hanging length, the one or more of the plurality of clothing items in the first tier of clothing items at least partially covers the second tier of clothing items.

6. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap is secured to the lower portion of the clothing item using a plastic tack having a thread-like body and tabbed ends, and the plastic tack is adapted to be removed by destroying the plastic tack without damaging the clothing item.

7. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap is made of nylon material.

8. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap is made of cloth material.

9. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap is secured to the clothing item using a plastic fastener that is adapted to be removed by destroying the plastic fastener without damaging the clothing item.

10. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger;

a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item; and a tab defining opposing ends each coupled to the lower portion of the clothing item, wherein the hanging strap extends between the opposing ends of the tab and between the tab and the lower portion of the clothing item to secure the hanging strap to the lower portion of the clothing item.

11. The assembly of claim 10, wherein the hanging strap is slidably adjustable relative to the tab.

12. A hanging clothing assembly comprising:

an article hanger having a body portion and an upper support portion;

a clothing item having a free-hanging length and defining an upper portion configured to be worn over an upper body of a wearer and a lower portion configured to be worn over a lower body of the wearer, the upper portion of the clothing item being supported on the body portion of the article hanger; and a hanging strap secured to the lower portion of the clothing item, the hanging strap releasably secured in a closed loop extending about the lower portion of the clothing item, the closed loop also being releasably secured to the article hanger such that the lower portion is supported from the article hanger and the clothing item defines a display-hanging length that is less than the free-hanging length of the clothing item;

wherein the hanging strap has a first end portion, a second end portion, and a mid-portion extending between the first and second end portions, the first and second end portions including complementary fasteners configured to be repeatedly coupled and uncoupled with one another, and the hanging strap forms the closed loop when the complementary fasteners of the first and second end portions are coupled to one another.

13. The assembly of claim 12, wherein:

the lower portion of the clothing item is gathered together to form a gathered section, and the closed loop extends around the gathered section, the upper support portion of the article hanger includes a hook, the closed loop extends around the hook to secure the gathered section of the clothing item to the hook, the clothing item being folded when the closed loop extends around the hook, and the hanging strap is secured to the clothing item using a plastic fastener that is adapted to be removed by destroying the plastic fastener without damaging the clothing item.

14. The assembly of claim 12, wherein the hanging strap is wrapped around the lower portion of the clothing item such that the lower portion of the clothing item is gathered together to form a gathered section, and the gathered section is releasably secured to the upper support portion of the article hanger such that the gathered section is supported by the hanging strap and the upper support portion.

15. The assembly of claim 14, wherein when the complementary fasteners of the first end portion and the second end portion of the hanging strap are uncoupled from one another, the hanging strap is unwrapped from around the lower portion of the clothing item and the gathered section is ungathered.

16. The assembly of claim 15, wherein the hanging strap is secured to the lower portion of the clothing item using a plastic fastener and is removable from the lower portion of the clothing item when the plastic fastener is destroyed.

17. The assembly of claim 14, wherein the gathered section is supported by the hanging strap and the upper support portion such that the gathered section is adjacent to the upper portion of the clothing item being supported on the body portion of the article hanger.

* * * * *